US010627085B2

(12) United States Patent
Hierzer

(10) Patent No.: US 10,627,085 B2
(45) Date of Patent: Apr. 21, 2020

(54) LUMINAIRE THAT IS RELIABLY ADJUSTABLE AND HAS REDUCED CONSTRUCTION HEIGHT

(71) Applicant: H4X e.U., Graz (AT)

(72) Inventor: Andreas Hierzer, Graz (AT)

(73) Assignee: H4X e.U., Graz (AT)

( * ) Notice: Subject to any disclaimer, the term of this patent is extended or adjusted under 35 U.S.C. 154(b) by 0 days.

(21) Appl. No.: 16/291,397

(22) Filed: Mar. 4, 2019

(65) Prior Publication Data

US 2019/0271456 A1 Sep. 5, 2019

(30) Foreign Application Priority Data

Mar. 2, 2018 (DE) ..... 10 2018 001 652

(51) Int. Cl.

| | |
|---|---|
| ***F21V 21/30*** | (2006.01) |
| ***F21V 29/70*** | (2015.01) |
| ***F21V 7/04*** | (2006.01) |
| ***F21V 14/02*** | (2006.01) |
| ***F21S 8/02*** | (2006.01) |
| *F21Y 115/10* | (2016.01) |

(52) U.S. Cl.

CPC ..... *F21V 21/30* (2013.01); *F21S 8/026* (2013.01); *F21V 7/04* (2013.01); *F21V 14/02* (2013.01); *F21V 29/70* (2015.01); *F21Y 2115/10* (2016.08)

(58) Field of Classification Search

CPC . F21V 21/30; F21V 29/70; F21V 7/04; F21V 14/02; F21Y 2115/10; F21S 8/026

See application file for complete search history.

(56) References Cited

U.S. PATENT DOCUMENTS

| | | | | |
|---|---|---|---|---|
| 2017/0227201 | A1 | 8/2017 | Fujisawa | |
| 2017/0307185 | A1* | 10/2017 | Boomgaarden | F21V 29/70 |
| 2019/0346215 | A1* | 11/2019 | Bodenweber | H01L 23/4006 |

FOREIGN PATENT DOCUMENTS

| | | | |
|---|---|---|---|
| DE | 19615639 | A1 | 10/1997 |
| DE | 20313905 | U1 | 1/2005 |
| DE | 102009057764 | A1 | 4/2011 |

OTHER PUBLICATIONS

Search report in corresponding EP19160428.9 dated Jul. 8, 2019 (pp. 1-12).

(Continued)

*Primary Examiner* — Tracie Y Green

(74) *Attorney, Agent, or Firm* — Millen, White, Zelano & Branigan, P.C.; William Nixon

(57) ABSTRACT

The present disclosure relates to a luminaire having a light generation device, a heat sink, a reflector and an intermediate element. The heat sink is pivotably coupled to the reflector about a pivot axis relative to said reflector. Light can be emitted into an inner space of the reflector by the light generation device. The intermediate element is mounted on the heat sink so that it can be moved relative to said heat sink and has a first section provided with a tooth system. The reflector has at least one second section provided with a tooth system. Engagement of the tooth systems of the first and second sections into one another counteracts pivoting of the heat sink relative to the reflector about the pivot axis. To pivot the heat sink relative to the reflector about the pivot axis, the tooth systems of the first and second sections can be disengaged.

15 Claims, 10 Drawing Sheets

(56) References Cited

OTHER PUBLICATIONS

Search report in corresponding EP19160428.9 dated Oct. 15, 2019 (pp. 1-10).
English Abstract of DE 19615639 A1 published Oct. 23, 1997.
English Abstract of DE 20313905 U1 published Jan. 5, 2005.
English Abstract of EP 2312200 A2 which corresponds to DE 102009057764 A1 published Apr. 14, 2011.

* cited by examiner (B-B)

LUMINAIRE THAT IS RELIABLY ADJUSTABLE AND HAS REDUCED CONSTRUCTION HEIGHT

FIELD OF THE INVENTION

The present invention relates to a luminaire.

TECHNICAL BACKGROUND

Although the invention may be useful in connection with luminaires of many different types and for a wide variety of fields of application, the invention and the problem on which it is based are explained further below using the example of a recessed luminaire.

Luminaires, such as for example recessed luminaires, are generally known as such. In many cases, in addition to creating agreeable illumination and the possibility of being able to orient the light cone of the luminaire in order to illuminate specific regions or objects in a targeted manner, value is also placed on an aesthetic ceiling appearance.

The applicant is aware of recessed luminaires that are able to be installed in a suspended ceiling in the manner of a downlight, for example. The applicant is furthermore aware of conventional recessed luminaires of this type that are designed so as to be pivotable in order to be able to appropriately orient the light cone emitted by the luminaire. Although, in one type of conventional luminaire, by virtue of pivoting the light cone out of the vertical, pivotable components of the luminaire are pivoted out of the plane of the ceiling and thereby become visible, such protrusion of pivotable parts of the luminaire in an inclined position of the radiation direction is avoided in another design known to the applicant.

In conventional adjustable luminaires, it may be the case that individual components of an adjustment mechanism, such as for example connecting elements in the form of screws or rivets, loosen over time and after a relatively long period of use, for example due to wear over a relatively long usage time, or else on account of the effect of heat. Even if the luminaire is still held as securely as before, this may be undesirable since, in such a case, the adjustment mechanism often no longer functions as intended and for example no longer reliably maintains the desired orientation selected by the user.

Furthermore, conventional adjustable luminaires are often constructed in a less compact and space-saving manner than appears desirable. In particular in the case of recessed luminaires, a reduced construction height may be desirable, for example.

This is a state that needs to be improved.

SUMMARY OF THE INVENTION

One of the ideas of the invention is to specify a luminaire that is able to be adjusted reliably and easily to the orientation of the light radiation direction over time and/or has a reduced construction height. In particular, the luminaire is additionally intended to allow the creation of a discreet and aesthetic ceiling appearance.

A luminaire having a light generation device, a heat sink, a reflector and an intermediate element is accordingly proposed. In this case, the heat sink is pivotably coupled to the reflector about a pivot axis relative to the reflector. The light generation device is arranged on the heat sink such that light is able to be emitted into an inner space of the reflector by the light generation device. The intermediate element is mounted on the heat sink so as to be able to move relative to the heat sink. It is furthermore provided that the intermediate element has at least one first section provided with a tooth system and the reflector has at least one second section provided with a tooth system. Engagement of the tooth systems of the first and second sections into one another in this case counteracts pivoting of the heat sink relative to the reflector about the pivot axis. For pivoting of the heat sink relative to the reflector about the pivot axis, the tooth systems of the first and second sections are able to be disengaged.

Furthermore, a luminaire having a light generation device, an at least sectionally dome-shaped reflector and a heat sink designed in the shape of a helmet is proposed. In this case, the heat sink is pivotably coupled to the reflector about a pivot axis relative to the reflector. The light generation device is arranged on the heat sink such that light is able to be emitted into an inner space of the reflector by the light generation device. It is furthermore provided that the heat sink protrudes beyond the reflector and, as a result, the reflector is sectionally received in an inner region of the heat sink.

One of the discoveries on which the present invention is based is that reliable and precise setting of a luminaire is able to be achieved through the use of toothed sections that engage in one another. A luminaire setting that is selected once is able to be reliably maintained by virtue of the positive-locking engagement of the tooth systems in one another. A kind of "latching-in" in a desired position is thus possible by way of the tooth systems. Insufficient function of the adjustment mechanism caused by loosening rivets, screws or the like is avoided with the aid of the tooth systems. In particular, the use of the tooth systems furthermore also allows precise setting of the luminaire. The luminaire is furthermore able to be operated easily in order to adjust it. In particular, the luminaire may furthermore for example avoid the requirement to disassemble the luminaire for adjustment. In addition, reliable adjustability is able to be achieved easily with only a few components, using the heat sink, the intermediate element and the reflector. The adjustment mechanism formed by the tooth systems has a long life and is stable. A further idea on which the invention is based is that, using a helmet-shaped heat sink that protrudes beyond the reflector, a small construction size and in particular small construction height is able to be achieved but with good heat dissipation. In addition, by way of the helmet-shaped design of the heat sink protruding beyond the reflector, pivoting of the heat sink relative to the reflector is able to be made possible in a simple manner.

Since, in the invention, the luminaire is adjusted by pivoting the heat sink together with the light generation device that is arranged thereon, pivoting of the reflector out of the plane of the ceiling, for example, is able to be avoided. A person viewing the luminaire therefore sees only the main radiation direction that is set on the radiated light cone, that is to say for example whether a light cone is radiated vertically or in an inclined manner. It is possible to prevent an unpleasant change in the ceiling appearance. A bumpy ceiling appearance, as may arise when the light is perceived differently by the viewer after setting procedures than it was before, for instance because the setting causes luminaire components to protrude into the room, is able to be avoided.

Advantageous refinements and developments of the invention result from the dependent claims and from the description with reference to the figures of the drawing.

In one refinement, a spring force is applied to the intermediate element with respect to the heat sink in a direction along which the intermediate element is able to move relative to the heat sink. The intermediate element is thus able to be held reliably in position. In particular, the engagement of the tooth systems is able to be reliably ensured.

In one refinement, the luminaire has at least one spring device that applies a spring force to the intermediate element with respect to the heat sink such that the tooth system of the first section is pressed against the tooth system of the second section. The toothed geometries of the first and second sections are therefore able to be held in engagement under the prestress provided by the spring device.

In one development, the intermediate element is guided in a straight line relative to the heat sink so as to be able to move on the heat sink. To this end, the intermediate element and the heat sink may be equipped with mutually correspondingly designed guide devices. Such a guide is able to be implemented in a comparatively simple manner.

In one refinement, at least the tooth system of the second section is arranged along an arc, in particular along a circular arc. In this way, reliable engagement of the tooth systems is able to be made possible for different positions of the intermediate element relative to the reflector.

In one refinement, the second section provided with a tooth system is arranged on an outer side of the reflector. In this way, the second section is readily accessible for the above-described engagement of the tooth systems.

In a further refinement, it is provided that the intermediate element has two first sections each provided with a tooth system and the reflector has two second sections each provided with a tooth system. Undesired pivoting of the heat sink relative to the reflector is thus able to be counteracted in an even more improved, reliable and stable manner.

In one refinement, the intermediate element is designed as an at least regionally cap-shaped or bowl-shaped component with an opening. The intermediate element may thus take on a covering function around the opening in a space-saving manner.

In one refinement, the heat sink is pivotably coupled to the reflector relative to the reflector within a predefined pivoting range. The reflector in this case has a passage on its rear side that allows light to be emitted by the light generation device into the inner space of the reflector for positions of the heat sink relative to the reflector within the pivoting range. According to this refinement, the intermediate element is designed as a covering element that, in the positions of the heat sink relative to the reflector within the pivoting range, in each case substantially covers the passage of the reflector outside a region of the passage that is used, in the position of the heat sink during operation of the light generation device, to emit the light into the inner space of the reflector. The intermediate element may in particular largely cover the passage outside the region used for light emission into the inner space of the reflector such that, in all provided pivoting positions of the heat sink, an undesired emission of light on the rear side out of the inner space of the reflector, for example into the space behind a suspended ceiling, is avoided. In this case, the term "pivoting position" is intended to comprise all positions of the heat sink in the pivoting range, in particular including the possible end positions, and in particular including a position in which light is emitted for example vertically with respect to an installation plane, provided that such a position is provided. In this refinement, an emission of light from the reflector on the rear side thereof, for instance through a gap between the heat sink and the reflector, is able to be avoided. Light losses that could reduce luminosity are thus avoided, and a more efficient use of the reflector is able to be achieved. An intermediate element provided according to this refinement is advantageous in connection with the tooth systems provided in the case of a luminaire according to the invention, but may also be useful as a covering element if such tooth systems are not necessarily provided.

The pivoting range is in this case in particular an angular range about the pivot axis.

In one development, the size of the angular range is approximately 30 degrees, for example.

By way of example, the pivoting range may comprise an end position in which a main radiation direction thereof is oriented substantially normal to an installation plane of the luminaire. It is thus possible to create a "downlight" function with substantially vertically downward radiation of the light cone.

In one development, the reflector may be at least sectionally designed in a dome shape. In particular, the rear-side passage of the reflector may be designed as a through-aperture in a curved bowl-shaped section of the reflector.

In one refinement, it is provided that the heat sink is designed in a helmet shape and protrudes beyond both the reflector and the intermediate element. In particular, the reflector and the intermediate element are therefore each sectionally received in an inner region of the heat sink. In this way, a low installation height of the luminaire is advantageously able to be achieved, which may be useful in particular in the case of a recessed luminaire.

In particular, the heat sink may be designed such that the heat sink overlaps the reflector to a greater extent on one side of the pivot axis in one of its end positions relative to the reflector, and therefore receives said reflector in the inner region to a greater extent than on the other side. In this way, the pivoting function is made possible with at the same time more effective cooling but low space requirements.

In one refinement, the reflector has trunnion pins that define the pivot axis. Furthermore, the heat sink has recesses that are each assigned to the trunnion pins. The heat sink is in this case latched onto the reflector such that the trunnion pins are in each case pivotably received in one of the recesses. In particular, the trunnion pins of the reflector may in this case latch into the recesses of the heat sink. The reflector and the heat sink are therefore able to be coupled a simple manner by being plugged together in a latching manner.

In one refinement, the luminaire furthermore has a lens that is configured and arranged so as to deflect and/or to bundle the light provided by the light generation device. In this case, it is provided that the intermediate element has a preferably circular reception region, adjusted to a size and shape of the lens and in which the lens is at least sectionally received. Effective deflection and/or bundling of the light is thus able to be achieved.

The reception region of the intermediate element for the lens is in particular formed by an opening in the intermediate element, for instance the abovementioned opening of the intermediate element in its at least regionally cap-shaped or bowl-shaped design.

In one refinement, the lens is coupled to the intermediate element such that, when an operator presses on the lens from a visible side of the luminaire, the tooth systems of the first and second sections are able to be disengaged in order to pivot the heat sink relative to the reflector. In this case, the operator may press in particular counter to the spring force provided by the spring device. As a result, flexible adjustment of the heat sink and thus of the light emission device is made possible in a simple manner by pressing on the lens, and in particular after installation of the luminaire without disassembling or deconstructing said luminaire. Additional effort for the setting procedure is avoided. Simple and uncomplicated operation is achieved for the user.

In one refinement, the luminaire is designed as a recessed ceiling spotlight. The opportunity to discreetly adjust the luminaire may often be useful in such an installation situation.

In one refinement, a frame is furthermore provided into which the reflector is able to be latched such that the latched-in reflector is able to be twisted relative to the frame about a centre axis of the reflector. The luminaire is thus able to be latched into the frame. The frame, together with the luminaire, may form a lighting arrangement.

Extensive orientation and setting possibilities are thus made possible for the light emitted by the luminaire. Twisting about the centre axis of the reflector may additionally provide an additional adjustment axis without in the process leading to bumps in the appearance of the installation plane, for example of the ceiling. Latching in furthermore makes the luminaire easy to assemble and disassemble.

In one development, the reflector may be equipped with latching devices, for example spring-loaded balls, that allow the reflector to be latched into the frame and allow the reflector to be twisted about the centre axis.

In one refinement, the pivot axis, about which the heat sink is pivotably coupled to the reflector relative to the reflector, is arranged substantially normal to the centre axis about which the reflector is able to be twisted in the frame. This contributes to extensive and flexible adjustability.

In particular, the frame of the luminaire may be designed as an installation frame that is able to be installed for example in a ceiling such that the centre axis of the reflector is oriented substantially perpendicular to an installation plane, for instance a plane of the ceiling.

In particular, in an end position of the heat sink that is defined by the above-described pivoting range, in one refinement, the light generation device may radiate into the inner space of the reflector substantially parallel to the centre axis.

In one refinement, the heat sink is formed of a metal material, and the reflector and the intermediate element are each formed of a plastic material. A heat sink according to this refinement is robust and has good thermal conduction properties, whereas the reflector and the intermediate element are able to be manufactured in a relatively inexpensive and weight-saving manner. The heat sink may be pressure die-cast, for example. The reflector and the intermediate element may be produced by way of plastic injection moulding, for example.

In one refinement, the light generation device is designed with an LED device that is arranged on the heat sink. The LED device may have one LED or a plurality of LEDs as light sources. Such a light generation device is able to accept comparatively little installation space and furthermore contribute to saving energy.

The light generation device is preferably attached to the heat sink. In one refinement, the heat sink may in particular have a mounting surface for the LED device. The LED device may for example have an LED circuit board that is mounted directly on the heat sink. Heat generated by the LED device during operation is in this case able to be dissipated effectively into the heat sink.

It is understood that the above refinements and developments are each able to be applied to both luminaires proposed according to the invention.

The above refinements and developments may be combined with one another as desired, if practical. Further possible refinements, developments and implementations of the invention also encompass combinations—not explicitly mentioned—of features of the invention described above or below with reference to the exemplary embodiments. In particular, a person skilled in the art will in this case also add individual aspects as improvements or supplementations to the respective basic form of the present invention.

BRIEF DESCRIPTION OF THE DRAWINGS

The present invention is explained in more detail below with reference to the exemplary embodiments specified in the schematic figures of the drawings, in which.

The accompanying drawings are intended to convey a further understanding of the embodiments of the invention. They illustrate embodiments and, in association with the description, serve to clarify principles and concepts of the invention. Other embodiments and many of the advantages mentioned are evident in view of the drawings. The elements of the drawings are not necessarily shown in a manner true to scale with respect to one another.

In the figures of the drawings, identical, functionally identical and identically acting elements, features and components—unless explicitly stated otherwise—are provided in each case with the same reference signs.

DESCRIPTION OF EXEMPLARY EMBODIMENTS

A luminaire 1 according to a first exemplary embodiment, and components of the luminaire 1, are illustrated in FIGS. 1 to 25. The luminaire 1 is designed as a recessed ceiling spotlight or adjustable "downlight" and creates a discreet ceiling appearance and pleasant lighting conditions while having a compact structure and a comparatively small diameter.

Figure 1:
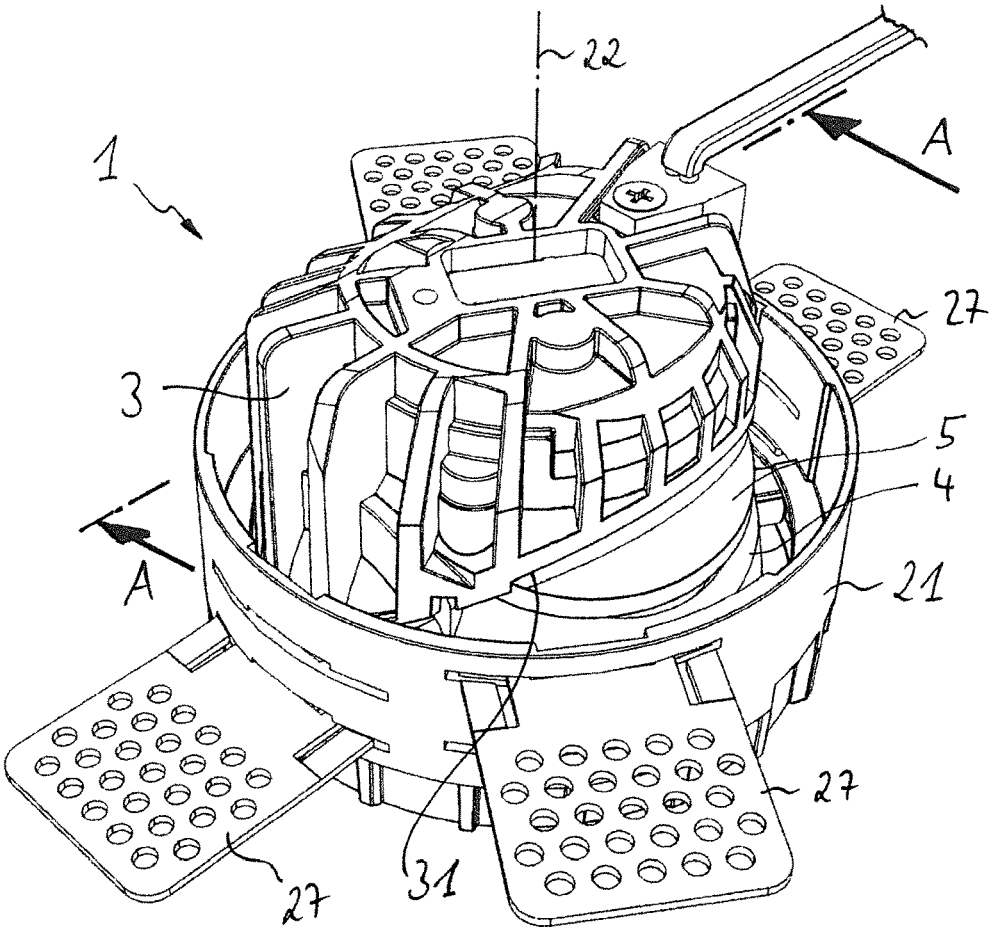
FIG. 1 shows a luminaire and an installation frame into which the luminaire is inserted, according to a first exemplary embodiment, in a perspective view from a rear side.

FIG. 1 shows the luminaire 1 that, together with a substantially circular installation frame 21, forms a lighting arrangement. The frame 21 may be installed for example in a round aperture in a suspended false ceiling, which is not illustrated in more detail in FIG. 1. To this end, the installation frame 21 may be fastened in the ceiling region by way of lug-type fastening devices 27 that are coupled for example to the frame 21 on an outer side of the frame 21 at different heights and positions. The luminaire 1 is releasably latched into the frame 21 and is able to be twisted relative to the frame 21 about a centre axis 22 of a reflector 4 relative to the frame 21. In this case, the luminaire 1 may be able to twist about the centre axis 22 in relation to the frame 21 about an angle of 360 degrees or more, or about an angle of slightly less than 360 degrees, for example about approximately 355 degrees.

The luminaire 1 has a light generation device 2, a helmet-shaped heat sink 3, an at least sectionally dome-shaped reflector 4 and an intermediate element 5. The heat sink 3 protrudes beyond both the reflector 4 and the intermediate element 5, as a result of which the reflector 4 and the intermediate element 5 are each received with a section in an inner region 24 of the heat sink 3, see FIGS. 2 and 10.

Figure 10:
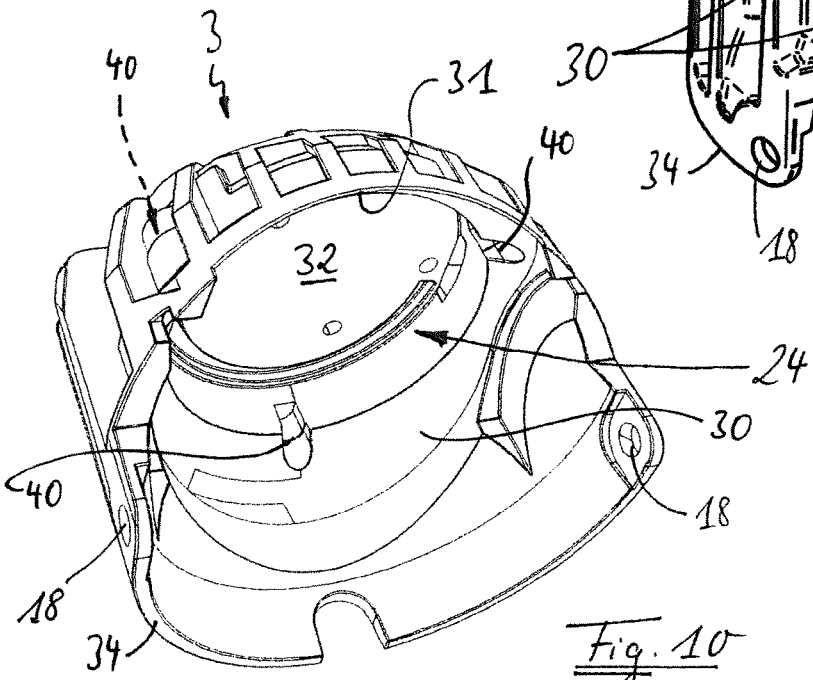
FIG. 10 shows the heat sink from FIG. 7 in a perspective internal view.
Figure 11:
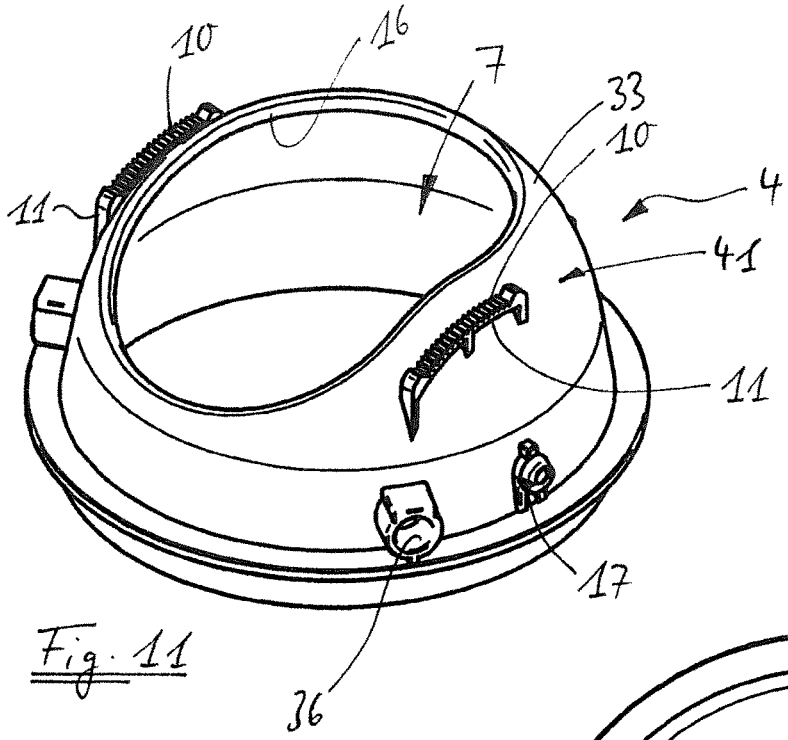
FIG. 11 shows a reflector of the luminaire of FIG. 1 in a perspective rear view.
Figure 12:
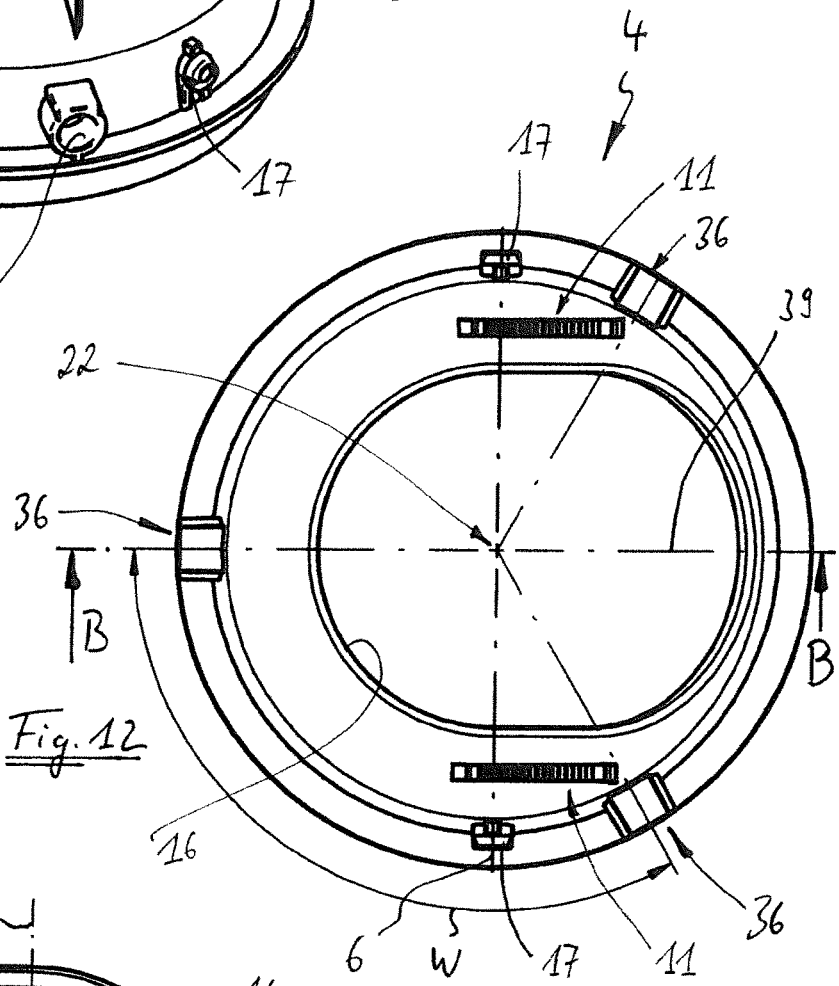
FIG. 12 shows the reflector from FIG. 11 in a rear view.
Figure 13:
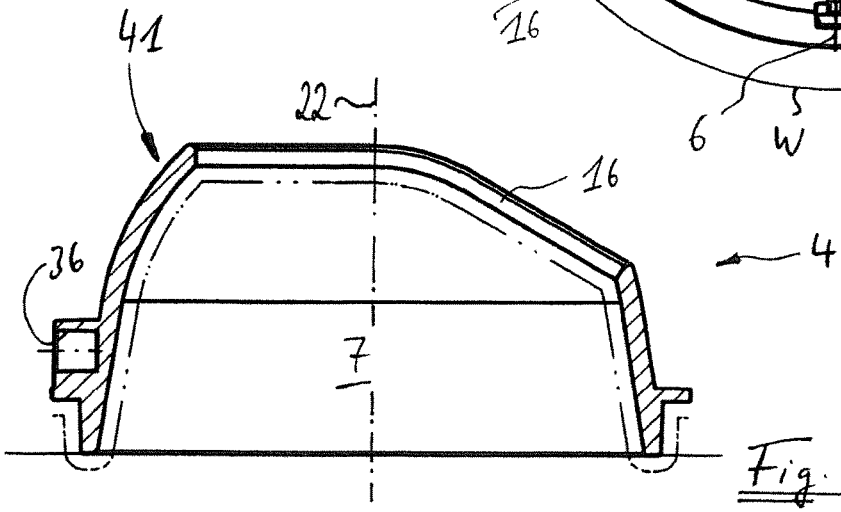
FIG. 13 shows the reflector from FIG. 11 in a section B-B, as indicated in FIG. 12.
Figure 14:
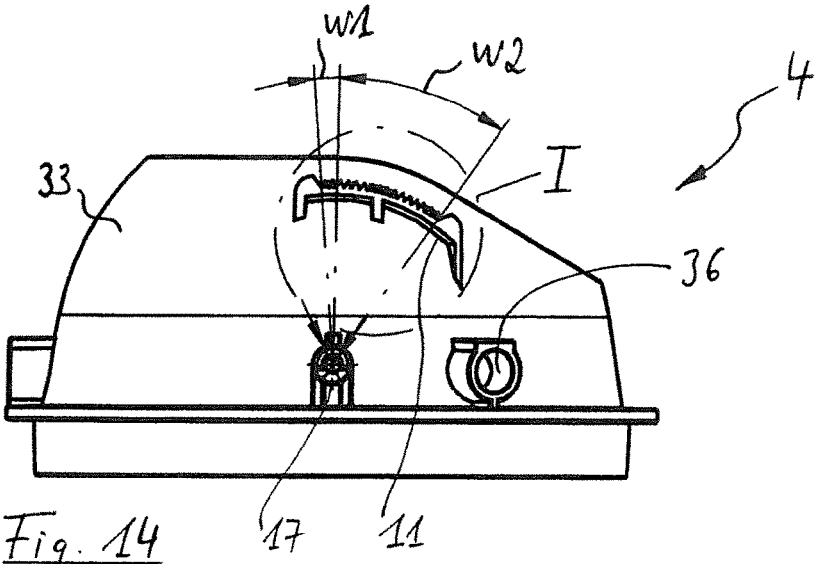
FIG. 14 shows the reflector from FIG. 11 in a side view.
Figure 15:
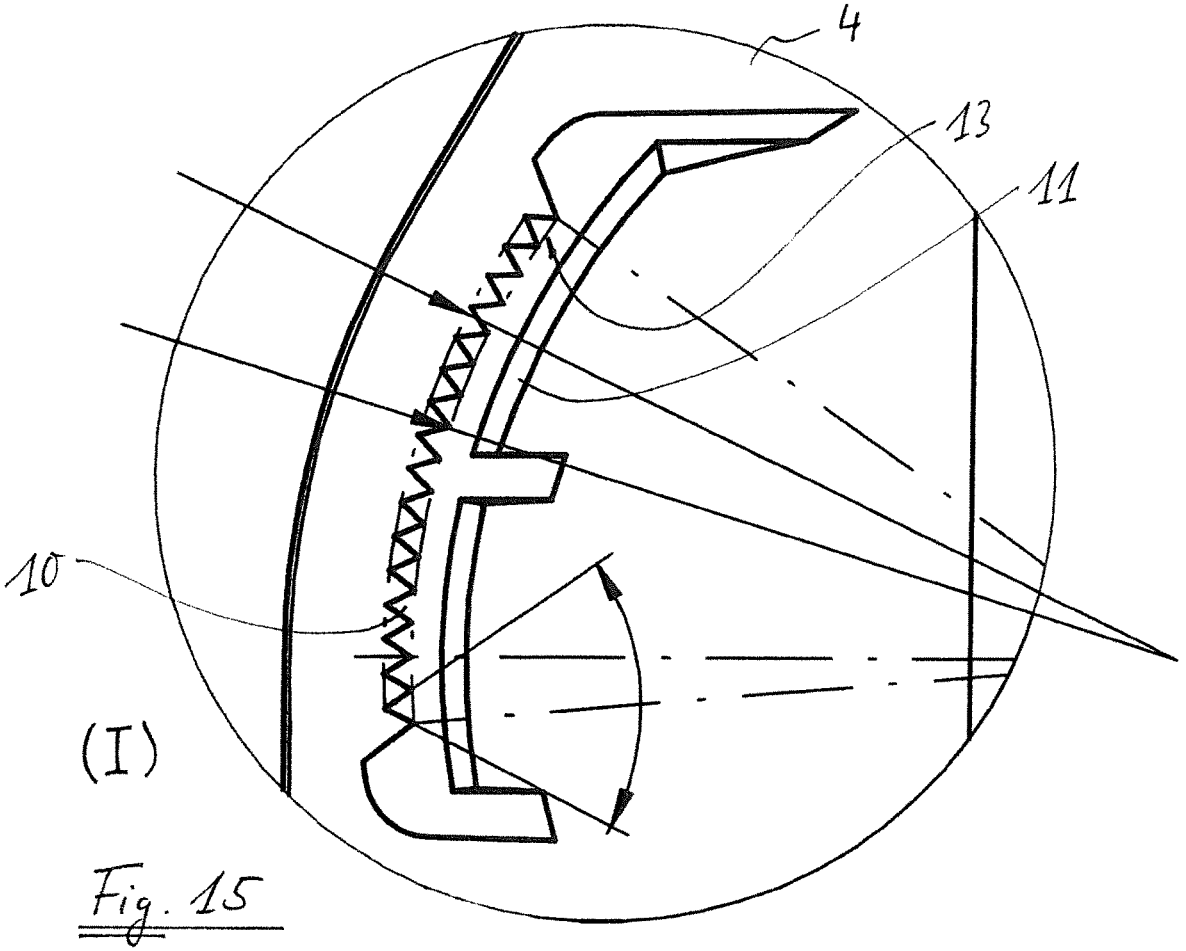
FIG. 15 shows a detail I of the reflector, as indicated in FIG. 14.
Figure 16:
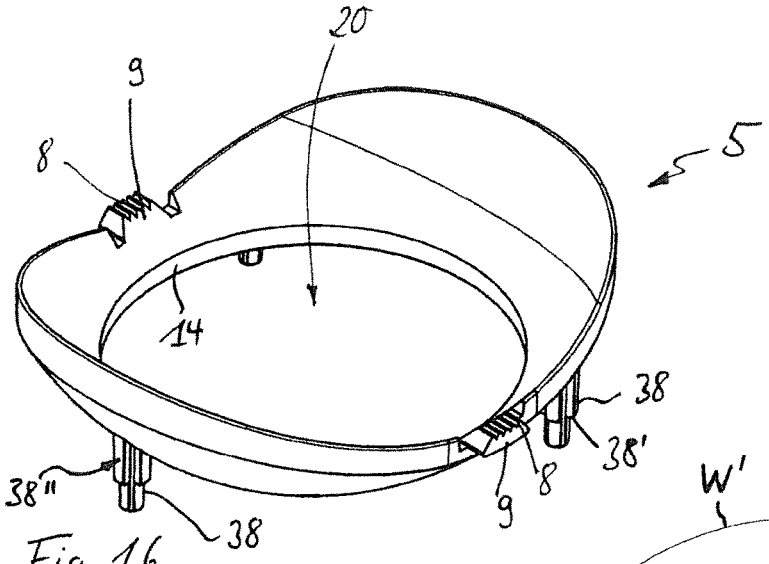
FIG. 16 shows an intermediate element of the luminaire of FIG. 1 in a perspective internal view.
Figure 18:
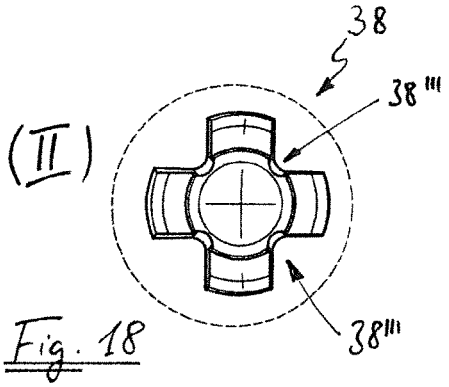
FIG. 18 shows a detail II of the intermediate element, as indicated in FIG. 17.
Figure 17:
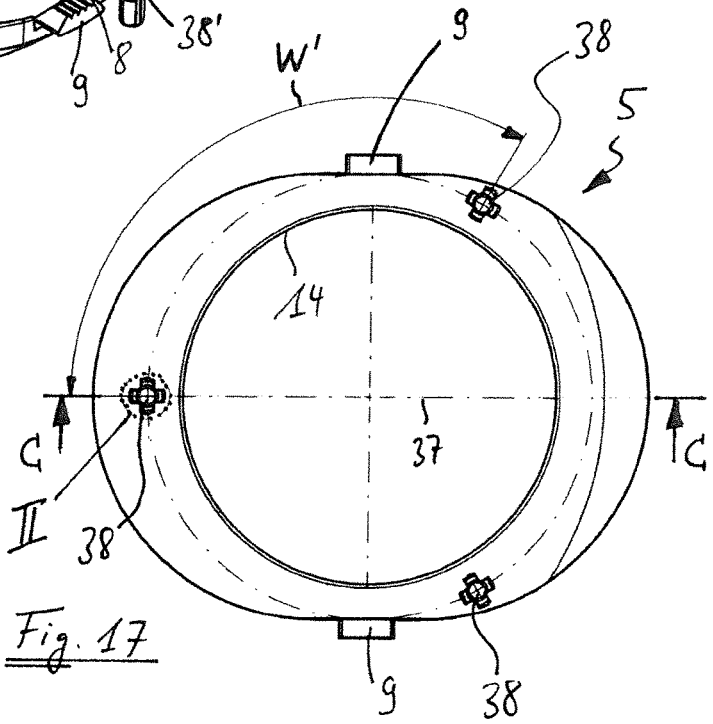
FIG. 17 shows the intermediate element of FIG. 16 in a rear view.
Figure 19:
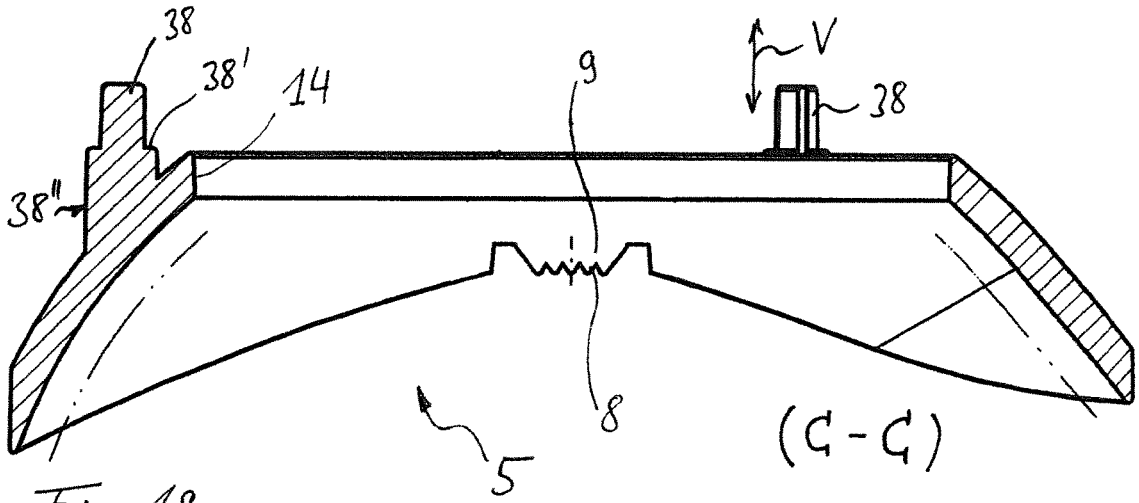
FIG. 19 shows the intermediate element of FIG. 16 in a section C-C, as indicated in FIG. 17.
Figure 20:
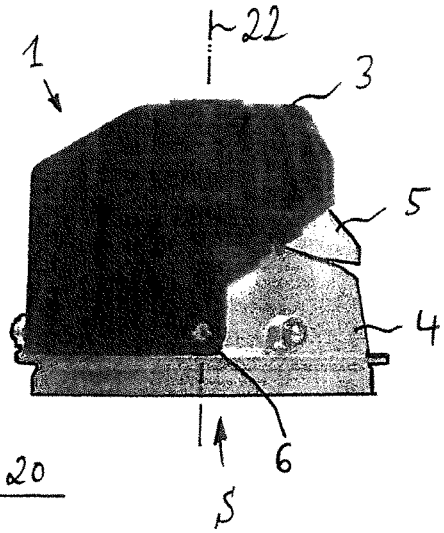
FIG. 20 shows a side view of the luminaire of FIG. 1, the heat sink adopting a first position in relation to the reflector.

The light generation device 2 comprises an LED device 23 having one or more LEDs that provide the light to be radiated by the luminaire 1. FIG. 10 shows, in the inner region 24 of the heat sink 3, a mounting surface 32 thereof that is designed as a flat inner face of the heat sink 3. The LED device 23 has an LED circuit board that is mounted directly on the heat sink 3 by way of the mounting surface 32. The light generation device 2 is therefore attached to the heat sink 3.

The light generation device 2 is arranged such that it is able to emit light into an inner space 7 of the reflector 4 during operation. This will be explained below.

The luminaire 1 has a lens 19 that is configured and arranged so as to deflect and/or to bundle the light provided by the light generation device 2. To this end, see FIGS. 5 and 6, the lens 19 is arranged in front of the light generation device 2 and has an outer shape substantially in the shape of a circular cylinder.

The intermediate element 5, which will be described in even more detail below, has a substantially circular opening 14 in the form of a through-aperture, whose shape and diameter are matched to the shape and the diameter of the lens 19. A section of the lens 19 is received in the opening 14. The opening 14 thus forms a reception region 20 for the lens 19.

Figure 4:
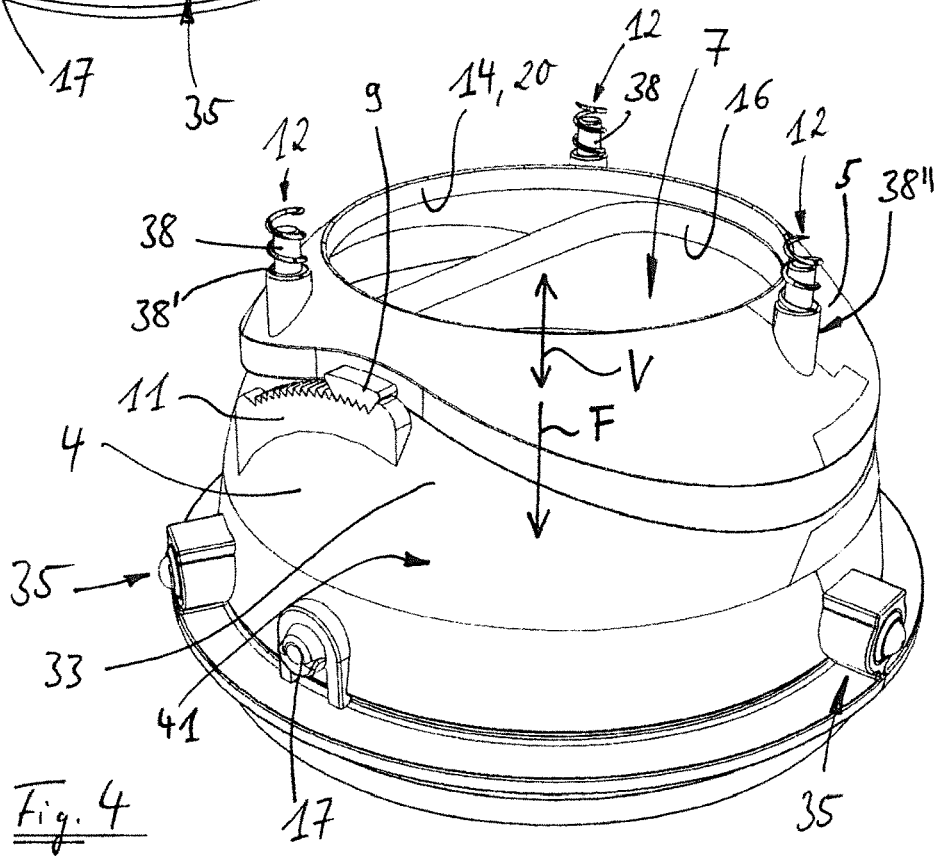
FIG. 4 shows a perspective view similar to FIG. 3, further components of the luminaire being omitted for improved clarity.
Figure 5:
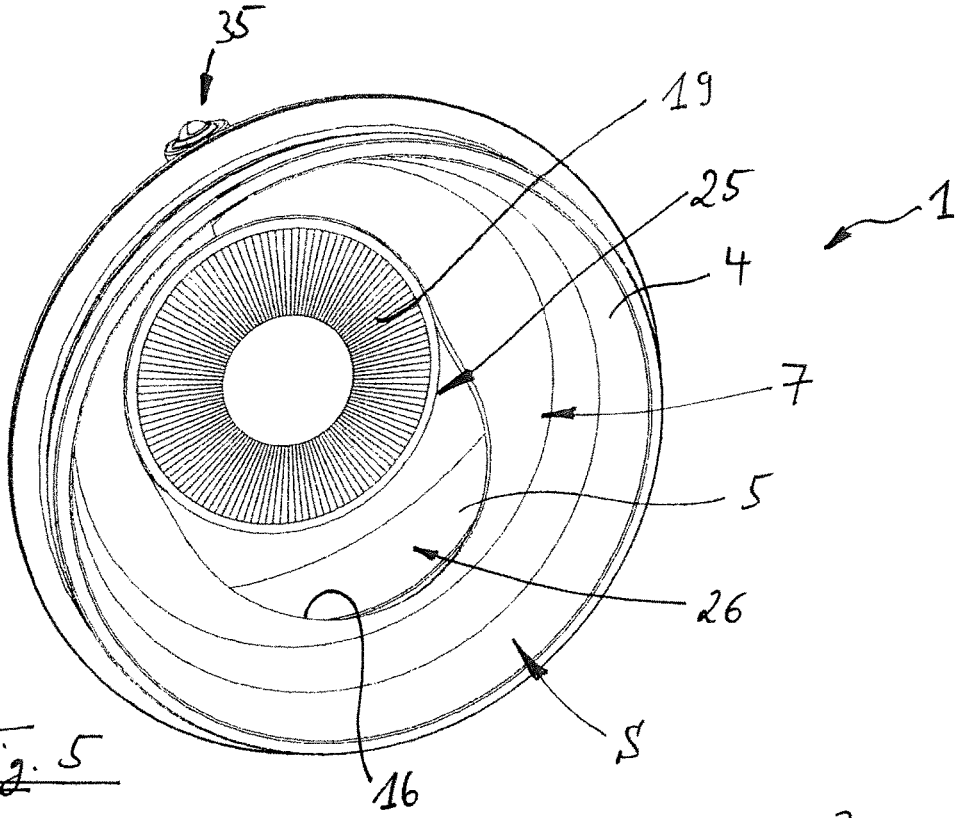
FIG. 5 shows the luminaire of FIG. 1 in a perspective front view.
Figure 6:
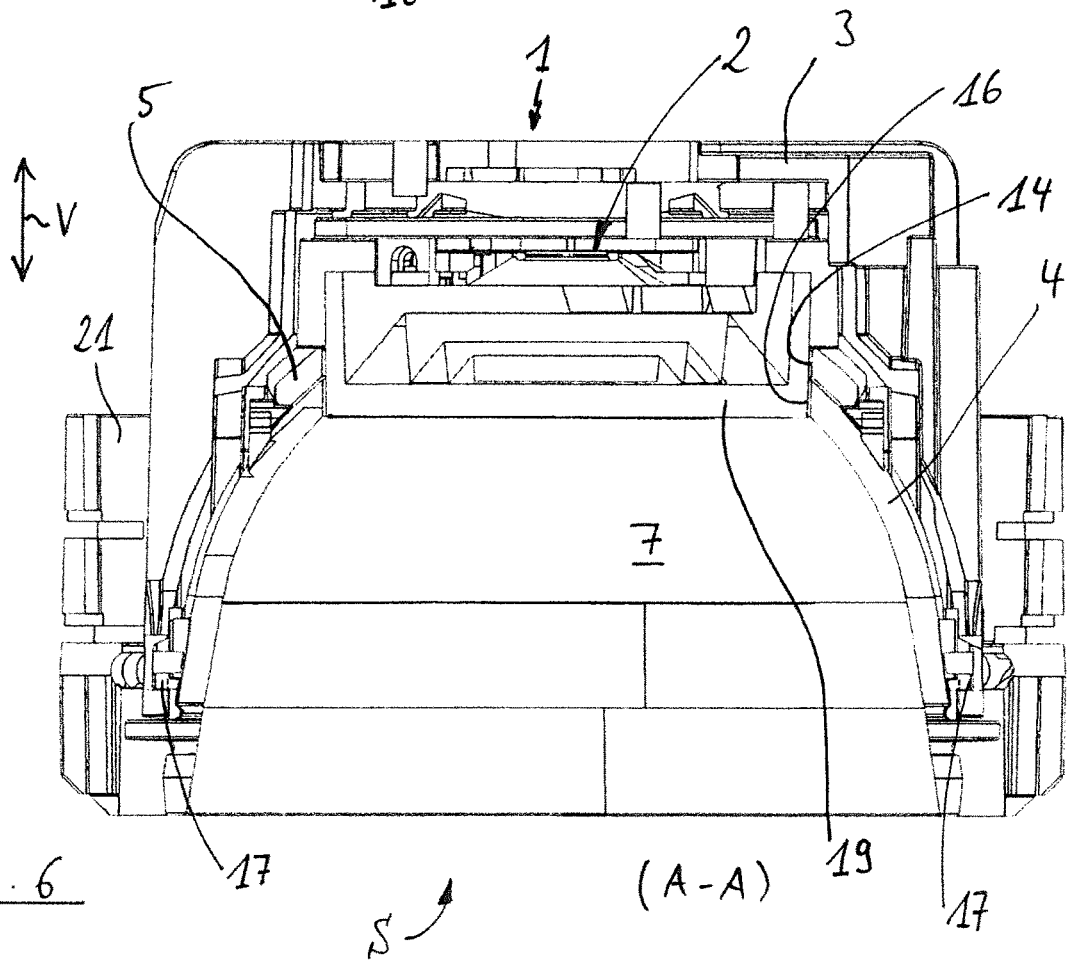
FIG. 6 shows the luminaire and the installation frame according to FIG. 1 in a section A-A, as indicated in FIG. 1.
Figure 9:
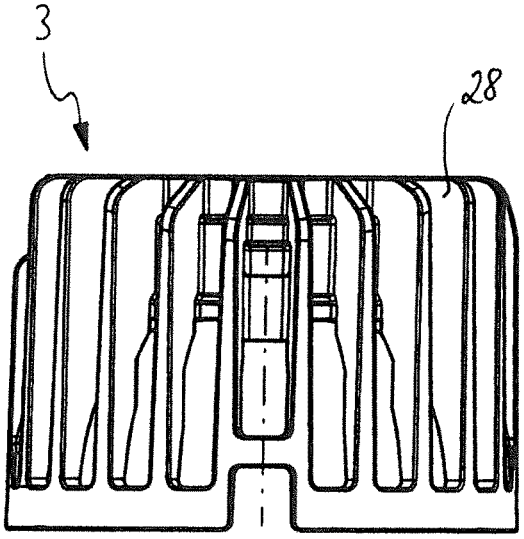
FIG. 9 shows the heat sink from FIG. 7 in a second side view.
Figure 8:
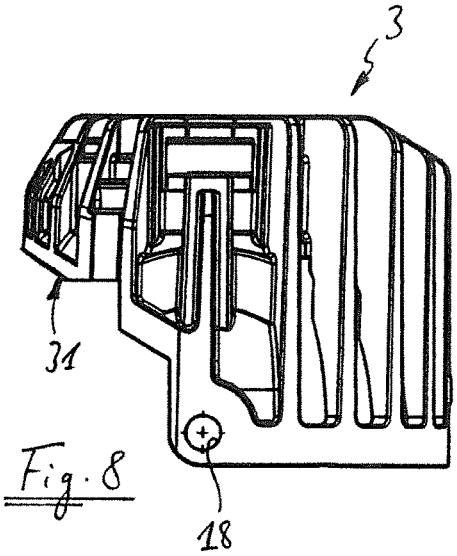
FIG. 8 shows the heat sink from FIG. 7 in a first side view.
Figure 7:
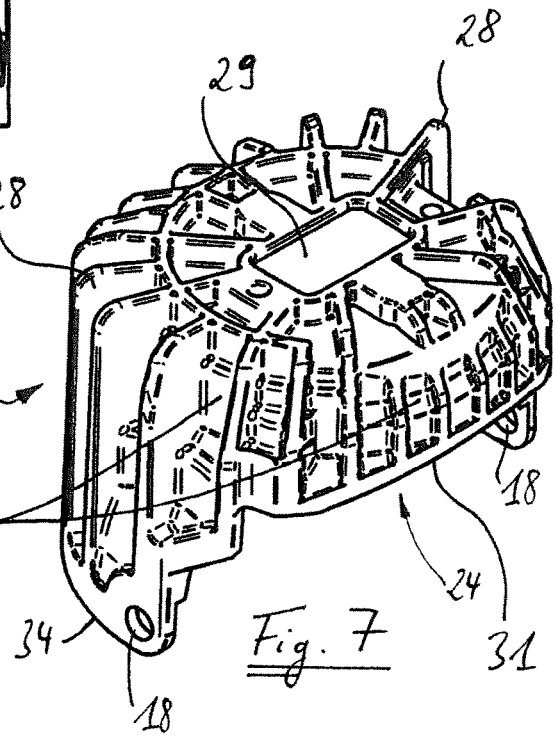
FIG. 7 shows a heat sink of the luminaire of FIG. 1 in a perspective rear view.

FIG. 4 shows that the intermediate element 5 is arranged on a rear and outer side 41 of the reflector 4. The reflector 4 is provided with a passage 16 on its rear side, see in particular FIGS. 4 and 11-13. The passage 16 is incorporated as a through-aperture into a curved, bowl-shaped section 33 of the reflector 4. In a view along the centre axis 22, see for instance FIG. 12, the passage is designed so as to be slightly elongate and also rounded.

The passage 16, in terms of its area, is larger than the opening 14 of the intermediate element 5. In FIG. 4, the opening 14 and the passage 16 are positioned above one another such that the opening 14 is not covered by parts of the reflector 4. The lens 19 protrudes through the opening 14 into the passage 16, see FIG. 6. Light bundled and/or deflected through the lens 19 from the light generation device 2 is thus able to be emitted into the inner space 7 of the reflector 4.

The heat sink 3 is pivotably coupled to the reflector 4, relative thereto, about a pivot axis 6 that is defined by two radially outwardly protruding trunnion pins 17 of the reflector 4. Pivoting of the heat sink 3 relative to the reflector 4 within a predefined pivoting range 15 is thus made possible, the pivoting range 15 about the pivot axis 6 being defined as an angular range of approximately 30 degrees with respect to the centre axis 22 in the first exemplary embodiment that is shown, see FIG. 23. The helmet-shaped heat sink 3, which is provided on its outer side with a multiplicity of ribs 28 for improving the cooling effect, see FIGS. 1, 2 and 7-10, has an inner region 24 that is delimited by an end wall 29 and a circumferential wall 30 of the heat sink 3. The circumferential wall 30 has a cutout 31 in a region that extends over approximately half the circumference of the heat sink. By virtue of the cutout 31, for pivoted positions of the heat sink 3 relative to its vertical position in FIG. 2, space is created for the reflector 4 and pivoting of the heat sink 3 about the axis 6 is made possible.

Figure 2:
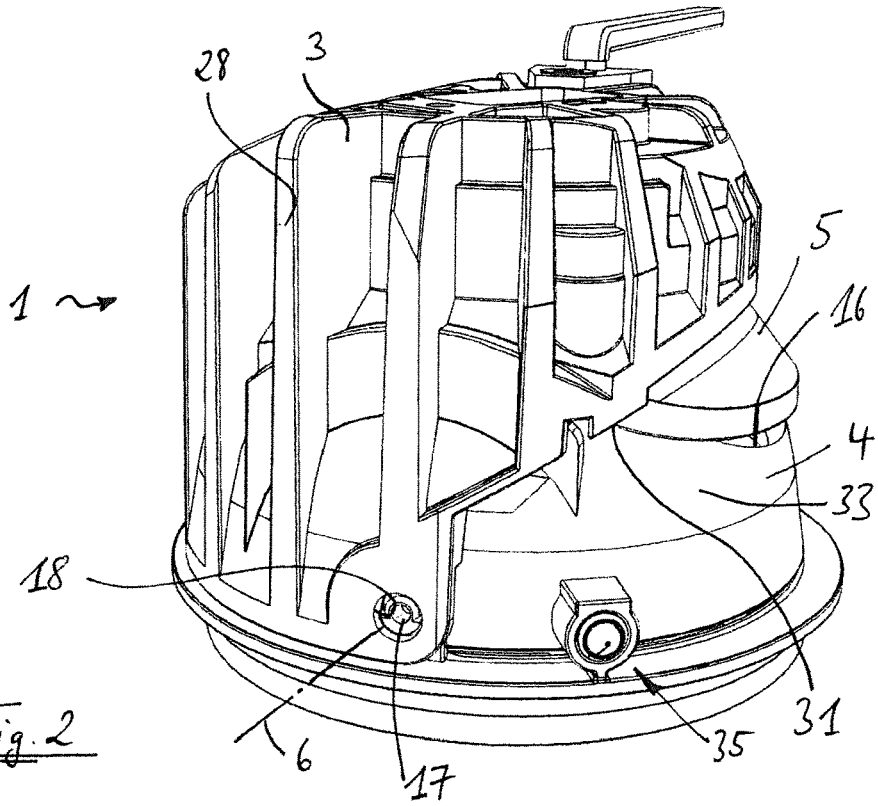
FIG. 2 shows the luminaire of FIG. 1 in a perspective side view, the frame being omitted for improved clarity.

FIG. 2 shows how the heat sink 3, in the vertical orientation of the heat sink 3 illustrated in this figure, largely receives the bowl-shaped section 33 of the reflector 4 in it in one half of the circumference of the reflector 4 between the two trunnion pins 17 on the left-hand side in FIG. 2, whereas part of the bowl-shaped section 33 juts out in the other half of the circumference of the reflector 4 in this position of the heat sink 3. The heat sink 3 and the reflector 4 therefore overlap more on one side of the pivot axis 6 than on the other side in FIG. 2.

Figure 23:
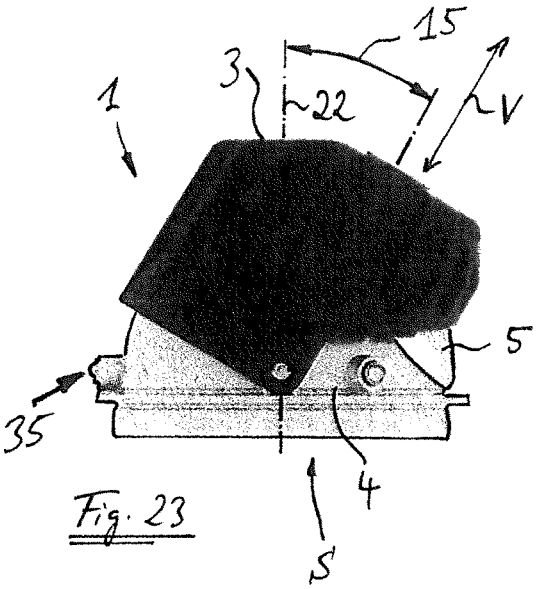
FIG. 23 shows a side view of the luminaire of FIG. 2, the heat sink being pivoted in comparison with its position in FIG. 20 and adopting a second position in relation to the reflector.
Figure 24:
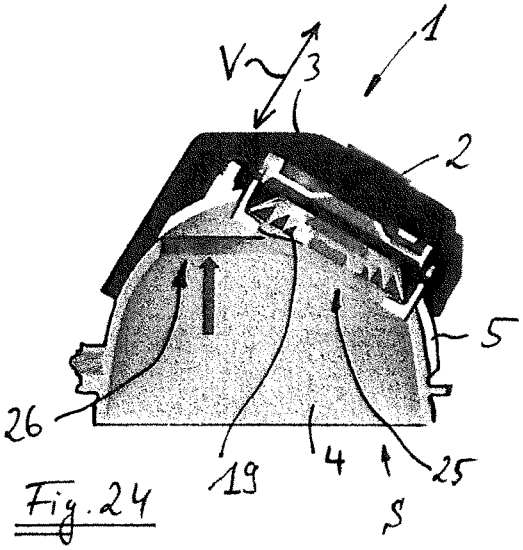
FIG. 24 shows the luminaire in the state of FIG. 23 in a central section.
Figure 22:
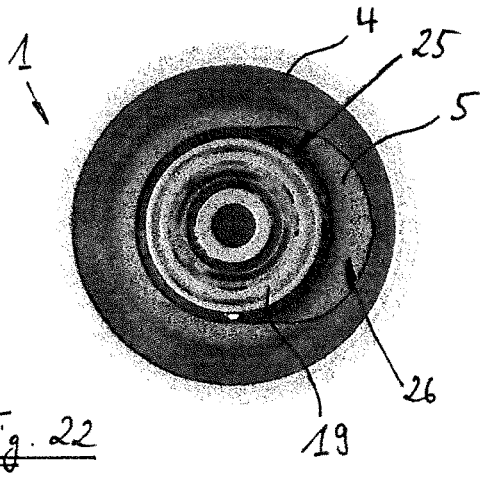
FIG. 22 shows the luminaire in the state of FIG. 20 in a front view from a visible side.
Figure 25:
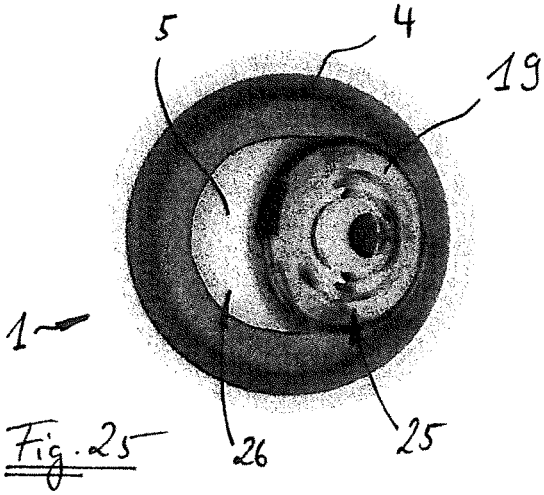
FIG. 25 shows the luminaire in the state of FIG. 23 in a front view from a visible side.
Figure 26:
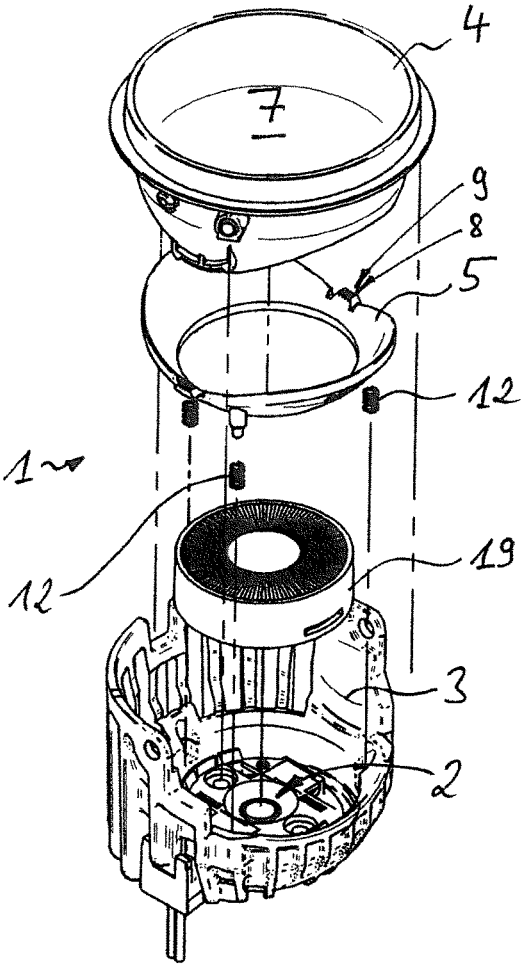
FIG. 26 shows a luminaire according to one variant of the first exemplary embodiment with a heat sink that is modified in comparison with the first exemplary embodiment, in an exploded view.
Figure 27:
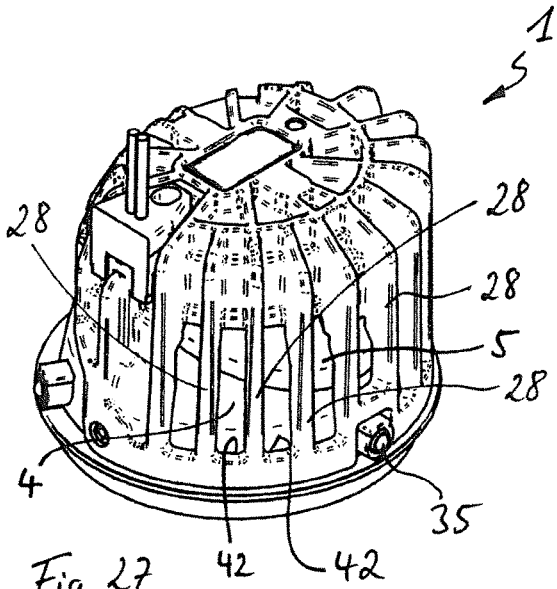
FIG. 27 shows the luminaire of FIG. 26 seen in perspective from a rear side.
Figure 30:
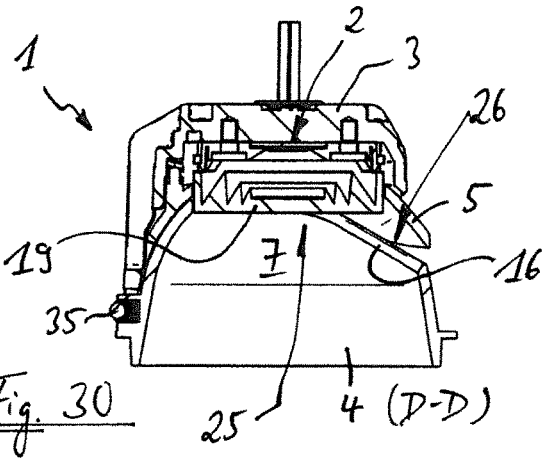
FIG. 30 shows the luminaire of FIG. 26 in a central section D-D according to FIG. 28.
Figure 28:
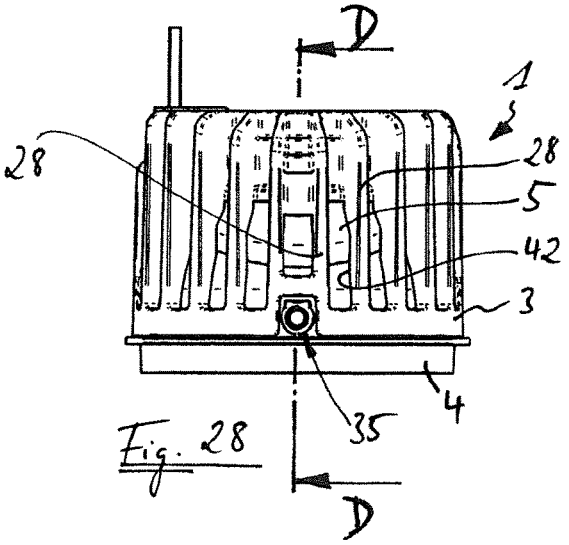
FIG. 28 shows the luminaire of FIG. 26 in a first side view.
Figure 29:
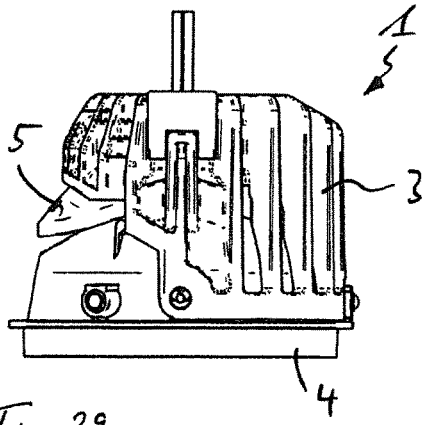
FIG. 29 shows the luminaire of FIG. 26 in a second side view.

A targeted orientation of a light cone generated by the luminaire 1 is made possible by adjusting the heat sink 3 relative to the reflector 4 about the pivot axis 6. The heat sink 3 is in this case pivoted together with the intermediate element 5, the lens 19 and the light generation device 2. A first end position of the heat sink 3 is illustrated in FIGS. 2 and 20 to 22, and a second end position thereof is illustrated in FIGS. 23 to 25, the end positions, illustrated by way of example, delimiting the angular range 15 in the sketched exemplary embodiment. In the first end position, light is emitted into the inner space 7 of the reflector 4 along a main direction that is substantially parallel to the centre axis 22 of the reflector 4. The luminaire 1 therefore radiates its light cone substantially parallel to the centre axis 22 in this first position, for instance vertically downwards in the case of installation in a horizontal ceiling.

FIG. 23-25 make it possible to see for example that components of the luminaire 1 advantageously do not protrude out of the reflector 4 on the visible side S of said luminaire in any of the pivoting positions. The centre axis 22 of the reflector 4 may remain unchanged, whereas the light radiated outwardly by the luminaire 1 through the reflector 4 is oriented by pivoting the heat sink 3 together with the light generation device 2 and the lens 19. The luminaire 1 thus always gives a discreet, unchanged ceiling appearance, but nevertheless allows effective orientation of the light cone that is generated. The viewer then does not perceive any change or impairment of the aesthetic appearance of the luminaire 1 when adjusting the light cone.

By way of the combination of the ability of the heat sink 3 to pivot about the pivot axis 6 and the ability of the reflector 4, and therefore of the luminaire 1, to twist about the centre axis 22, a flexible and extensive orientation of the light generated by the luminaire 1 is achieved. The centre axis 22 and the pivot axis 6 are in this case substantially perpendicular to one another, wherein, in the case of a substantially horizontal installation of the frame 21 in the ceiling, the pivot axis 6 is oriented horizontally and the centre axis 22 is oriented vertically. The centre axis 22 is in this case in particular perpendicular to an installation plane, not shown in more detail, which corresponds for example to the plane of the ceiling. Twisting the luminaire 1 about the centre axis 22 does not affect the ceiling appearance.

The heat sink 3, see for example FIG. 2, 7, 8, 10, has recesses 18 that are configured as round through-apertures and are arranged at a distance of 180 degrees along the circumference of the heat sink 3. The recesses 18 are provided adjacent to an outer edge 34 of the circumferential wall 30 and the two end regions of the cutout 31. When the luminaire 1 is assembled, the heat sink 3 is latched onto the reflector 4 from the outer side 41 of the reflector 4, as a result of which each of the two trunnion pins 17 latches into an associated one of the two recesses 18 and is received pivotably in the recess 18 after latching in.

Latching of the luminaire 1 into the frame 21 is made possible by way of latching devices 35 arranged on the reflector 4. In the case of the luminaire 1, the latching devices 35 are each designed as a spring-loaded and radially outwardly pointing ball. The latching devices 35 may also be called ball catches. The balls are each received in an appropriate receptacle 36 on the reflector 4. Three receptacles 36 for balls of the latching devices 35 are arranged at a distance in each case corresponding to an angle W of 120 degrees about the centre axis 22 on the outer circumference of the reflector 4, see in particular FIG. 12. The balls may latch into a circumferential groove of the frame 21 and also allow the latched-in reflector 4 to be twisted about the centre axis 22. The latching-in by way of the latching devices 35 is such that the latch connection between the luminaire 1 and the frame 21 is able to be released again, as a result of which simple disassembly of the luminaire 1 is possible.

The intermediate element 5 designed with a cap shape or bowl shape is shown in more detail in FIG. 16-19. On both sides of an axis of symmetry 37, see FIG. 17, the intermediate element 5 in each case has a first section 9, wherein each of the two first sections 9 is provided with a respective tooth system 8. The intermediate element 5 is furthermore equipped with three pin-type guide devices 38 that are oriented parallel to one another and arranged at a distance corresponding to an angle W' of approximately 120 degrees about the opening 14. The guide devices 38 and the tooth systems 8 point in opposing directions. Each tooth system 8 has five teeth by way of example in the exemplary embodiment that is shown. The sections 9 are arranged symmetrically with respect to the axis 37.

The reflector 4, which is illustrated in more detail in FIGS. 11-15, has, on both sides of an axis of symmetry 39, in each case a first section 11 on the outer side 41 of the reflector 4. Each of the two sections 11 is provided with a tooth system 10. Each of the tooth systems 10 is arranged along a circular arc 13, see FIG. 15, wherein the centre of the circle of the arc 13 lies substantially on the axis 6. Each of the tooth systems 10 in the illustrated exemplary embodiment extends over an angular range of approximately W1+W2=40 degrees, where W1=5 degrees and W2=35 degrees, see FIG. 14. In the exemplary embodiment that is shown, each of the tooth systems 10 has for example a number of 16 teeth along the arc 13. The sections 11 are arranged symmetrically with respect to the axis 39.

The heat sink 3, see for example FIG. 10, is equipped with three guide devices 40 that are designed as recesses in the heat sink 3 that are open towards the inner region 24. The guide devices 40 correspond in terms of form and position to the guide devices 38 of the intermediate element 5, such that the intermediate element 5 is able to be inserted into the inner region 24, and in the process the pin-type guide devices 38 are each inserted into the guide devices 40 in the form of recesses. The intermediate element 5 is therefore mounted so as to be able to move in a straight line on the heat sink 3 along a movement direction V parallel to the direction of extent of the guide devices 38, and thus for example in the vertical direction in FIG. 6. The intermediate element 5 is thus able to be moved parallel to the direction V relative to the heat sink 3.

Furthermore, a spring device 12 that is in each case designed as a spring is applied between the heat sink 3 and the intermediate element 5 on each of the pin-shaped guide devices 38. See for example FIGS. 3 and 4, in which the spring devices 12 are plugged onto pins that serve as guide devices 38. In addition, it is also illustrated, in particular in FIGS. 3, 4, 16 and 19, that the guide devices 38 are each designed with a thicker section and a thinner section that merge into one another in the region of a step 38'. The spring device 12 may in each case sit on the step 38', see FIGS. 3 and 4. Lateral guidance may be achieved through an outer surface 38" of the thicker sections of the guide devices 38.

Figure 3:
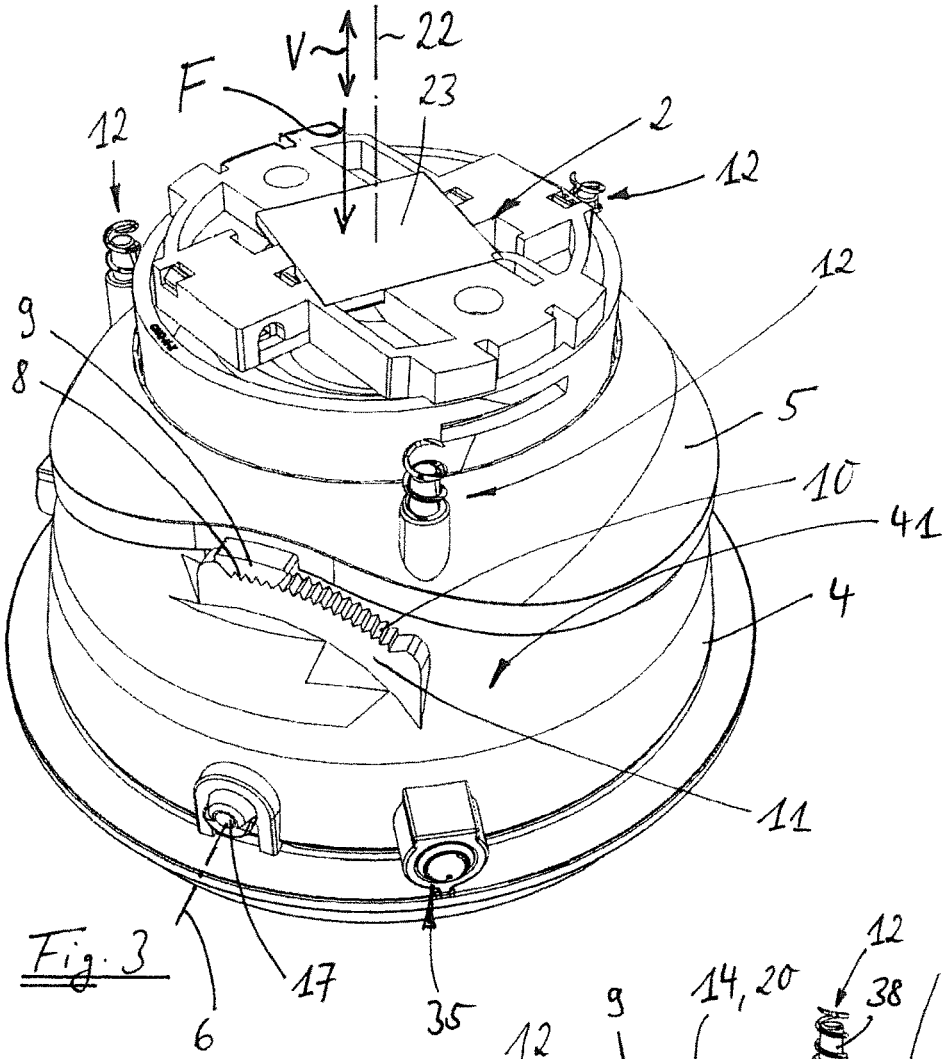
FIG. 3 shows a few assembled components of the luminaire of FIG. 1 in a perspective view.

It is pointed out that FIGS. 3 and 4 show the guide devices 38 in a first variant in which the respective thicker and thinner section are formed by way of a substantially cylindrical outer surface that is uninterrupted in its circumferential direction. By contrast, the outer surfaces of the guide devices 38 in FIG. 16-19 are provided with additional longitudinal grooves 38'" in one variant, the spring device 12 however again sitting on the step 38'.

The spring devices 12 apply a spring force F to the intermediate element 5 parallel to the direction V, see for example FIG. 3, 4, oriented in the direction away from the heat sink 3 and towards the reflector 4. The spring devices 12 are supported on the heat sink 3 in this case.

Under the effect of the spring devices 12, the tooth systems 8 are pressed against the tooth systems 10 and engage in one another. The design of the tooth systems 8 is such that the tooth system 8 of the first section 9, which is configured so as to be shorter, is able to engage in the tooth system 10 of the second section 11, which is designed so as to be longer, along the circular arc 13 at various positions. The tooth systems 8 and 10 are thus designed so as to be matched to one another in order to be able to create such engagement.

The engagement of the tooth systems 8 and 10 in one another counteracts pivoting of the heat sink 3, and therefore also of the light generation device 2, about the pivot axis 6 relative to the reflector 4. A pivoting position of the heat sink 3, and therefore of the light cone that is generated, that is set once is thus reliably and accurately maintained.

The luminaire 1 makes it possible to change the heat sink 3 and therefore the orientation of the emitted light without the luminaire 1 having to be taken out of the frame 21. For this purpose, an operator presses on the visible side S of the luminaire 1, see for example FIG. 5 or 6, counter to the spring force F on the lens 19. The lens 19 is able to move relative to the heat sink 3 and is coupled to the intermediate element 5 in such a way that, by pressing on the lens 19, the tooth systems 8 and 10 lift away from one another counter to the force direction F and disengage. In this case, the extent of the movement by which the intermediate element 5 is able to be moved counter to the spring force F is enough to be able to disengage the tooth systems 8, 10.

The lens 19 is thus in this case pressed in the direction towards the heat sink 3. In this state, the heat sink 3 may be pivoted together with the light generation device 2, the intermediate element 5 and the lens 19 about the pivot axis 6. In the desired angular position of the heat sink 3, the operator stops pressing on the lens 19, as a result of which the tooth systems 8 and 10 engage again and the desired orientation of the heat sink 3 is set. Under the effect of the spring devices 12, the heat sink 3 is thus able to be held in any desired positions in the pivoting range 15 that are possible in said pivoting range. The lens 19 may for example be attached to the intermediate element 5 in the opening 14.

An adjustment about the centre axis 22 may also take place without having to take the luminaire 1 out of the frame 21. The luminaire 1 is thus able to be adjusted in many ways without requiring disassembly.

In a direction parallel to the pivot axis 6, a dimension of the passage 16 in the reflector 4 corresponds substantially to a diameter of the opening 14 in the intermediate element. The lens 19 protrudes through the opening 14, as a result of which light deflected and/or bundled by way of the lens 19 is able to be emitted into the inner space 7 of the reflector 4. When pivoting about the pivot axis 6, the intermediate element 5 moves along with the heat sink 3 and moves in the region of the outer side 41 of the reflector 4 in such a way that the passage 16 always remains substantially covered outside the region of the lens 19. See for example FIG. 5, which shows this for a vertical position of the heat sink 3, and for example FIG. 24, which illustrates the covering of the passage for a pivoted position of the heat sink 3.

Figure 21:
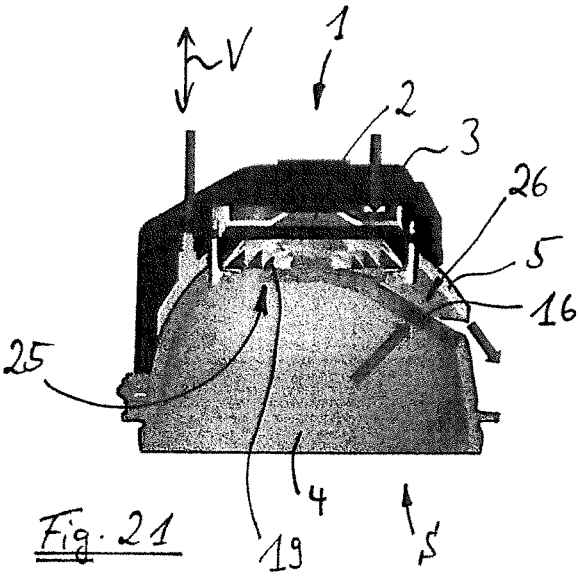
FIG. 21 shows the luminaire in the state of FIG. 20 in a central section.

For each pivoting position of the heat sink 3 relative to the reflector 4 within the pivoting range 15, light is thus able to be emitted by the light generation device 2 into the inner space 7, while undesired emission of light on the rear side of the reflector 4 is avoided. Light losses connected to such a light emission are thus also avoided. The intermediate element 5 thus acts as a covering element able to move on the reflector outer side 41 and that moves along with the heat sink 3 when pivoting about the axis 6. A region 25 of the passage 16 through which the lens 19 in each case protrudes in a pivoting position of the heat sink 3 is used for emitting light into the inner space 7, whereas a remaining region 26, or remaining regions in the case of an intermediate position, of the passage 16 outside the region 25 is/are substantially covered by the intermediate element 5 in each pivoting position of the heat sink 3 in the pivoting range 15. In this way, for all possible positions of the heat sink 3, when the heat sink 3 is pivoted, substantially no gap that is visible from the visible side S is created on the rear side of the reflector 4. Whereas FIG. 21 shows that the intermediate element 5 prevents such a gap in the vertical end position of the heat sink 3, FIG. 24 shows this for an inclined position of the heat sink 3. In FIG. 21, the region 26 is covered by the intermediate element 5, although the heat sink 3 does not completely cover the region 26 in this figure. In FIG. 24, the intermediate element 5 covers the region 26 that is present in the position that is shown, despite simultaneous overlapping by the heat sink 3.

A luminaire 1 according to one variant of the first exemplary embodiment having a modified heat sink 3 is shown in FIG. 26-30, the luminaire 1 according to FIG. 26-30 differing slightly from the luminaire 1 as was described above for the first exemplary embodiment in that, in FIG. 26-30, the heat sink 3 is additionally interrupted between some of the cooling ribs 28, and therefore has apertures 42 between some of the ribs 28. A section of the intermediate element 5 is visible through the apertures 28, which section in this case again advantageously provides a covering function in addition to the function of the toothing system 8. The apertures 42 may contribute to a weight saving and improve aeration of the outer side of the reflector 41 and of the intermediate space between the heat sink 3 and the reflector 4.

Figure 32:
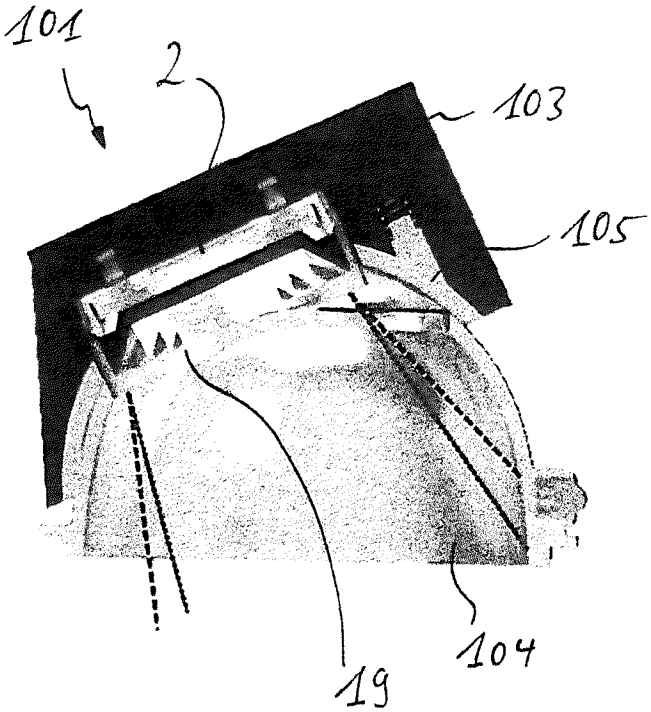
FIG. 32 shows the luminaire of FIG. 26 in a central section for a second position of the heat sink.
Figure 31:
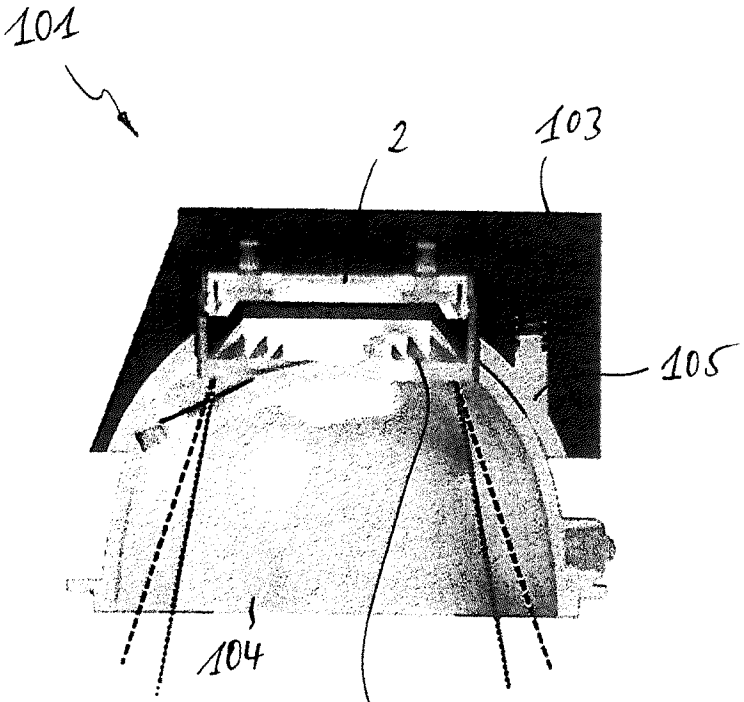
FIG. 31 shows a luminaire according to a second exemplary embodiment in a central section for a first position of the heat sink.

A luminaire 101 having a light generation device 2, a heat sink 103, a reflector 104 and an intermediate element 105 according to a second exemplary embodiment is shown in FIGS. 31 and 32. The second exemplary embodiment differs from the first exemplary embodiment with regard to the form of the heat sink 103, which, in the second exemplary embodiment, extends downward beyond the reflector 104 to a lesser extent on that side thereof that moves away from an aperture of the reflector 104, and upwards in FIG. 32, when the heat sink 103 is pivoted, and therefore does protrude beyond the reflector, but receives it therein to a lesser extent.

In the above-described exemplary embodiment, the heat sink 3, 103 is formed from a metal material, for example pressure die-cast. The reflector 4, 104 and the intermediate element 5, 105 are each produced from a plastic material, for example injection moulded. By way of example, the reflector 4, 104 and the intermediate element 5, 105 may be produced from a polycarbonate. The reflector 4, 104 and, if desired, also the intermediate element 5, 105 may be provided in a range of different colours, for example black, white, copper-coloured, chrome-coloured or gold-coloured. The reflector 4, 104 and, if desired, also the intermediate element 5, 105 may be vacuum-coated.

Although the present invention has been described completely above on the basis of preferred exemplary embodiments, it is not restricted thereto, but rather can be modified in diverse ways.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding German application No. 102018001652.9, filed Mar. 2, 2018, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A luminaire, comprising:

a reflector;

a heat sink pivotably coupled to the reflector about a pivot axis relative to the reflector;

a light generation device arranged on the heat sink such that light is able to be emitted into an inner space of the reflector by the light generation device; and an intermediate element mounted on the heat sink so as to be able to move relative to the heat sink, the intermediate element having at least one first section provided with a first tooth system and the reflector having at least one second section provided with a second tooth system, with an engagement of the first and second tooth systems into one another counteracting pivoting of the heat sink relative to the reflector about the pivot axis and, for pivoting of the heat sink relative to the reflector about the pivot axis, the first and second tooth systems can be disengaged.

2. The luminaire of claim 1, wherein a spring force is applied to the intermediate element with respect to the heat sink in a direction along which the intermediate element is able to move relative to the heat sink.

3. The luminaire of claim 1, further comprising at least one spring device that applies a spring force to the intermediate element with respect to the heat sink such that the first tooth system is pressed against the second tooth system.

4. The luminaire of claim 1, wherein at least the second tooth system is arranged along an arc.

5. The luminaire of claim 1, wherein the intermediate element is designed as an at least partially cap-shaped or bowl-shaped component with an opening.

6. The luminaire of claim 1, wherein the heat sink is pivotably coupled to the reflector relative to the reflector within a predefined pivoting range, the reflector having a passage on its rear side that allows light to be emitted by the light generation device into the inner space of the reflector for positions of the heat sink relative to the reflector within the pivoting range, and wherein the intermediate element is designed as a covering element that, in the positions of the heat sink relative to the reflector within the pivoting range, in each case substantially covers the passage of the reflector outside a region of the passage that is used, in the position of the heat sink during operation of the light generation device, to emit the light into the inner space of the reflector.

7. The luminaire of claim 1, wherein the heat sink is designed in a helmet shape and protrudes beyond both the reflector and the intermediate element.

8. The luminaire of claim 1, wherein the reflector has trunnion pins that define the pivot axis, and wherein the heat sink has recesses that are each assigned to the trunnion pins, the heat sink being latched onto the reflector such that the trunnion pins are in each case pivotably received in one of the recesses.

9. The luminaire of claim 1, wherein the luminaire furthermore has a lens that is configured and arranged so as to deflect or to bundle the light provided by the light generation device, the intermediate element having a circular reception region, adjusted to a size and shape of the lens and in which the lens is at least partially received.

10. The luminaire of claim 9, wherein the lens is coupled to the intermediate element such that, when an operator presses on the lens from a visible side of the luminaire, the first and second tooth systems are disengaged in order to pivot the heat sink relative to the reflector.

11. The luminaire of claim 1, further comprising a frame into which the reflector is latched such that the latched-in reflector can be twisted relative to the frame about a central axis of the reflector.

12. The luminaire of claim 11, wherein the pivot axis, about which the heat sink is pivotably coupled to the reflector relative to the reflector, is arranged substantially normal to the centre axis about which the reflector is able to be twisted in the frame.

13. The luminaire of claim 1, wherein the heat sink is formed of a metal material, with the reflector and the intermediate element each being formed of a plastic material.

14. The luminaire of claim 1, wherein the light generation device is designed with an LED device arranged on the heat sink.

15. The luminaire of claim 4, wherein at least the second tooth system is arranged along a circular arc.

* * * * *